US007815486B2

(12) United States Patent
Bernstein et al.

(10) Patent No.: US 7,815,486 B2
(45) Date of Patent: Oct. 19, 2010

(54) SPRING-POWERED TOY VEHICLE AND LAUNCHER

(75) Inventors: Michael Bernstein, Hermosa Beach, CA (US); Gabriel Carlson, Los Angeles, CA (US)

(73) Assignee: JAKKS Pacific, Inc., Malibu, CA (US)

( * ) Notice: Subject to any disclaimer, the term of this patent is extended or adjusted under 35 U.S.C. 154(b) by 256 days.

(21) Appl. No.: 11/975,681

(22) Filed: Oct. 18, 2007

(65) Prior Publication Data

US 2008/0166947 A1 Jul. 10, 2008

Related U.S. Application Data

(60) Provisional application No. 60/852,913, filed on Oct. 18, 2006, provisional application No. 60/853,527, filed on Oct. 20, 2006, provisional application No. 60/878,763, filed on Jan. 4, 2007.

(51) Int. Cl.
*A63H 29/00* (2006.01)

(52) U.S. Cl. ..... 446/429; 446/430; 446/431; 446/440; 446/457; 446/465

(58) Field of Classification Search ..... 446/429–431, 446/437, 440, 457, 464, 470, 441, 448, 465, 446/469, 471; 29/469; 273/129 M
See application file for complete search history.

(56) References Cited

U.S. PATENT DOCUMENTS 2,517,084 A * 8/1950 Carver ..... 446/430
2,528,494 A * 11/1950 Brookshier ..... 446/457
2,546,223 A * 3/1951 Jenkins ..... 446/457
2,594,527 A * 4/1952 Wechsler ..... 446/457
2,607,163 A * 8/1952 Lohr ..... 446/434
2,862,330 A * 12/1958 Malsed ..... 446/451
3,653,149 A * 4/1972 Prodger et al. ..... 446/471
3,670,453 A * 6/1972 Cosp ..... 446/457
3,713,514 A * 1/1973 Cosp ..... 185/37
3,785,086 A 1/1974 Escobedo
3,798,832 A 3/1974 Terzian
4,016,674 A * 4/1977 Resnick et al. ..... 446/409
4,201,011 A 5/1980 Cook (Continued)

OTHER PUBLICATIONS

International Preliminary Report on Patentability from PCT/US2007/022302.

*Primary Examiner*—Gene Kim
*Assistant Examiner*—Scott Young
(74) *Attorney, Agent, or Firm*—Tope-McKay & Associates

(57) ABSTRACT

The present invention relates to a spring-powered toy vehicle with a front body portion, a separable rear body portion, rotating wheels and a spring propulsion system. When the rear body portion is pulled away from the front body portion and released, the spring will pull the rear body portion back into the front body portion, thereby causing the vehicle to move forward. Parallel vehicle guides prevent the rear movable body portion from pulling away in a non-axial direction, thus guiding the propelled toy vehicle in a straight line. Other aspects provide interchangeable and replaceable springs, and body portions. Additionally, vehicle choices include autos, trucks, motorcycles, planes, and construction equipment. A launcher is included that provides a stable platform for launching the vehicles and additionally imparts, through a peg and notch assembly and a spring-loaded plunger, additional kinetic energy for propulsion.

6 Claims, 13 Drawing Sheets

U.S. PATENT DOCUMENTS 4,345,402 A * 8/1982 Hanson et al. ..... 446/430
4,411,098 A * 10/1983 Birdsall et al. ..... 446/457
4,443,966 A * 4/1984 Birdsall ..... 446/430
4,540,377 A * 9/1985 Rehkemper et al. ..... 446/430
4,639,236 A 1/1987 McKay et al.
4,737,135 A * 4/1988 Johnson et al. ..... 446/430
4,764,149 A 8/1988 Yoneyama
5,316,514 A 5/1994 Ellman et al.
5,626,505 A * 5/1997 Cheng ..... 446/278
5,667,421 A * 9/1997 Uetake ..... 446/470
5,674,105 A * 10/1997 Hamlin ..... 446/457
5,860,846 A * 1/1999 Uetake ..... 446/470
6,234,866 B1 * 5/2001 Ben-Yakar et al. ..... 446/431
6,805,609 B1 10/2004 Paukert et al.

* cited by examiner

SPRING-POWERED TOY VEHICLE AND LAUNCHER

PRIORITY CLAIM

This is a non-provisional patent application claiming the benefit of U.S. Provisional Patent Application No. 60/852,913, filed on Oct. 18, 2006, titled, "Spring-Powered Toy Vehicle," also claiming the benefit of priority of U.S. Provisional Patent Application No. 60/853,527, filed on Oct. 20, 2006, titled, "Self-Propelled Toy Vehicle," and also claiming the benefit of priority of U.S. Provisional Patent Application No. 60/878,763, filed on Jan. 4, 2007, titled "Spring-Actuated Self-Propelled Toy Vehicle".

BACKGROUND OF THE INVENTION (1) Technical Field

The present invention relates to the field of toy vehicles and, more specifically, to a spring-powered toy vehicle that uses a spring to propel the toy vehicle forward and also includes a launcher to initiate its propulsion.

(2) Background

Toy vehicles are numerous and have existed for many years. Self-propelled toy vehicles have been developed that contain a mechanism for driving the toy vehicle forward without requiring manual force. Many self-propelled toy vehicles have complex mechanisms and propulsion devices that lack durability or require expensive, complex electronics. A simple, inexpensive spring-powered toy vehicle with few moving parts that is durable and is fun for children to play with would be welcomed by children and the toy industry.

Thus, a continuing need exists for a spring-powered toy vehicle that uses a simple spring to propel the toy vehicle forward.

SUMMARY OF THE INVENTION

The present invention relates to a toy vehicle that is spring-powered. The spring-powered toy vehicle (for brevity called herein the "vehicle" or the "toy vehicle") has a front body portion with at least one wheel rotatably attached thereto and a separable rear body portion that also has at least one wheel rotatably attached thereto. A spring that connects with the front body portion and the rear body portion provides a propulsive force, such that when the rear body portion is pulled away from the front body portion, potential energy is created. When the rear body portion is released, the potential energy is converted to kinetic energy and the spring pulls the rear body portion into the front body portion. When the rear body portion impacts the front body portion, the kinetic energy is transferred to the front body portion propelling the entire vehicle forward quite rapidly. In an additional aspect, the spring is detachable and in another aspect the spring is interchangeable with springs of varying strengths. The vehicles have a right and left side.

A connecting rod and in one aspect a cylinder that contains the connecting rod, provides structural support for the spring, and parallel vehicle guides in another aspect prevent the rear movable body portion from pulling away in a non-axial direction, so that the toy vehicle will only be propelled in a straight line direction while twisting force on the spring is prevented. The vehicle guides are also designed to allow the front and rear body portions to have a maximum separation when the rear is pulled away from the front while at the same time allowing separation of the two portions. In another embodiment there are two vehicle guides, one on the left side of the vehicle and one on the right side of the vehicle and the two vehicle guides are comprised of tongue and groove assemblies.

In another aspect the vehicle can be an auto, a truck, a motorcycle, a plane or a construction vehicle. Non-limiting examples of construction vehicles include a wheeled bulldozer and a road-grader. Also provided for in this invention is a plurality of different versions of like vehicles. The rear body portion has a posterior and anterior end that can be detached from the front body portion, which also has a posterior and anterior end. The front and rear body portions from different versions of like vehicles are interchangeable. In another aspect, the front body portion has a hinged flip top at its anterior end, allowing the top to flip up, permitting easy access to the spring inside. This invention also teaches a rear body portion with a front segment, a back segment and the front segment has a top. The front body portion in this version is detachably attached on top of the front segment of the rear body section. The front segment of the rear body portion comprises at least one wheel and the back segment also comprises at least one wheel and a spring.

In a further aspect of the present invention, the spring-powered toy vehicle spring further comprises a spring assembly. The spring assembly comprises a connection rod sliding within a cylinder, surrounded by the spring. Both the cylinder and the connection rod contain end caps with a raised cylindrical band to which the spring attaches near each end of the assembly. Each end cap fits into a receptacle, one at the posterior end of the front body portion and the other into the anterior end of the rear body portion. One additional version of this invention has the raised cylindrical section on the cylinder at the cylinder end of the spring assembly, thus mandating only one end cap.

The connection rod and cylinder force the spring to expand in an axial direction along the direction of travel of the spring-powered toy vehicle. In another aspect of the present invention, the spring assembly is removable. In a further aspect of the present invention, the spring assembly is made in a plurality of strengths and colors and each is interchangeable for any of the spring powered toy vehicles.

In still another aspect of the present invention, the rear body portion further includes a handle for a user to grasp while pulling the rear body portion away from the front body portion. The front body portion has a top and on the top of the front body portion is a thumb notch. A user places a thumb on the thumb notch and then with the other hand of the user, the handle is grasped and the rear body portion is pulled away from the front body portion.

A launcher version of the vehicle uses a launcher to launch the vehicle and necessitates that the handle comprise a peg oriented perpendicular to the direction of travel of the vehicle. On this version, a notch is included on the bottom of the vehicle. The launcher provides a stable platform for launching the spring-powered toy vehicles. The launcher, having a launching end, a plunger end, and a closed interior. The launcher is comprised of a platform and ramp that includes an underside (contained in the closed interior of the launcher and is not visible to an observer) encased in a housing that has an axially oriented, spring-loaded plunger at the plunger end that is permitted to travel when it is pulled. Once released, the spring action returns it to its resting position. At the launching end of the ramp is a peg and slot assembly with an anterior and posterior end, the peg of the peg and slot assembly fits into the notch in the underside of the vehicle. The travel of the peg in the peg and slot assembly is less than the travel of the plunger. The peg travels with the vehicle when attached and moves as the plunger is pulled. Once the vehicle is released the peg returns to the anterior end of its slot. At the launching end of the plunger is a spring-loaded, hinged and pivoting u-shaped retaining receptacle that in its resting state is not allowed to pivot. The retaining receptacle is mounted on a rod that extends to the underside of the ramp (and hidden from view of an observer). Attached to the rod, on the underside of the ramp, is a rectangular plate that travels on the underside of the ramp with the plunger (as the plunger is pulled and returns) and the retaining receptacle.

The vehicle is set into the launcher so that its notch is secured on the peg of the peg and slot assembly and the peg of the handle is secured in the retaining receptacle. When the plunger is pulled, the peg and slot allows limited travel of the front body portion until that limit is reached. The plunger travels more than the peg and slot, causing the spring in the vehicle to expand and creating potential energy. Once the peg of the peg and slot reaches its maximum travel point, and the vehicle becomes stretched to its limit, the rectangular plate beneath the retaining receptacle rides up a pair of humps in the underside of the ramp. This causes the rectangular plate to tilt up which, in turn, causes the retaining receptacle to pivot down, thus releasing the vehicle. The potential energy of the spring loaded peg and slot, the spring loaded plunger and the spring of the vehicle are combined and converted into kinetic energy causing the vehicle to leap from the launcher at a furious pace.

In another aspect, the launcher has a base on its bottom and a tab is located at the launching end of the base. The tab is designed to fit into a slot on a track designed to accommodate the wheels of the vehicles. Once launched, the vehicles move on the track until the kinetic energy that drives them is spent.

This invention also teaches a method for forming a spring-powered toy vehicle that comprises attaching at least one rotatable wheel to a front body portion and at least one rotatable wheel to a rear body portion. The method also includes an act of removably attaching the front and rear body portions allowing the body sections to touch and achieve a limited separation point. Additionally, the method includes an act of placing a spring between each of the front and rear body portions.

Finally, as can be appreciated by one skilled in the art, the present invention further comprises a plurality of acts of forming and attaching the various parts of the toy vehicle and launcher described herein to arrive at the present invention.

BRIEF DESCRIPTION OF THE DRAWINGS

The objects, features and advantages of the present invention will be apparent from the following detailed descriptions of the disclosed aspects of the invention in conjunction with reference to the following drawings, where.

DETAILED DESCRIPTION

The present invention relates to a spring-powered toy vehicle The following description, taken in conjunction with the referenced drawings, is presented to enable one of ordinary skill in the art to make and use the invention and to incorporate it in the context of particular applications. Various modifications, as well as a variety of uses in different applications, will be readily apparent to those skilled in the art, and the general principles, defined herein, may be applied to a wide range of embodiments. Thus, the present invention is not intended to be limited to the embodiments presented, but is to be accorded the widest scope consistent with the principles and novel features disclosed herein. Furthermore, it should be noted that unless explicitly stated otherwise, the figures included herein are illustrated diagrammatically and without any specific scale, as they are provided as qualitative illustrations of the concept of the present invention.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents that are filed concurrently with this specification and are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the claims herein is not intended to invoke the provisions of 35 U.S.C. 112, Paragraph 6.

Please note, if used, the labels left, right, front, back, top, bottom, forward, reverse, clockwise and counter clockwise have been used for convenience purposes only and are not intended to imply any particular fixed direction. Instead, they are used to reflect relative locations and/or directions between various portions of an object.

Figure 1:
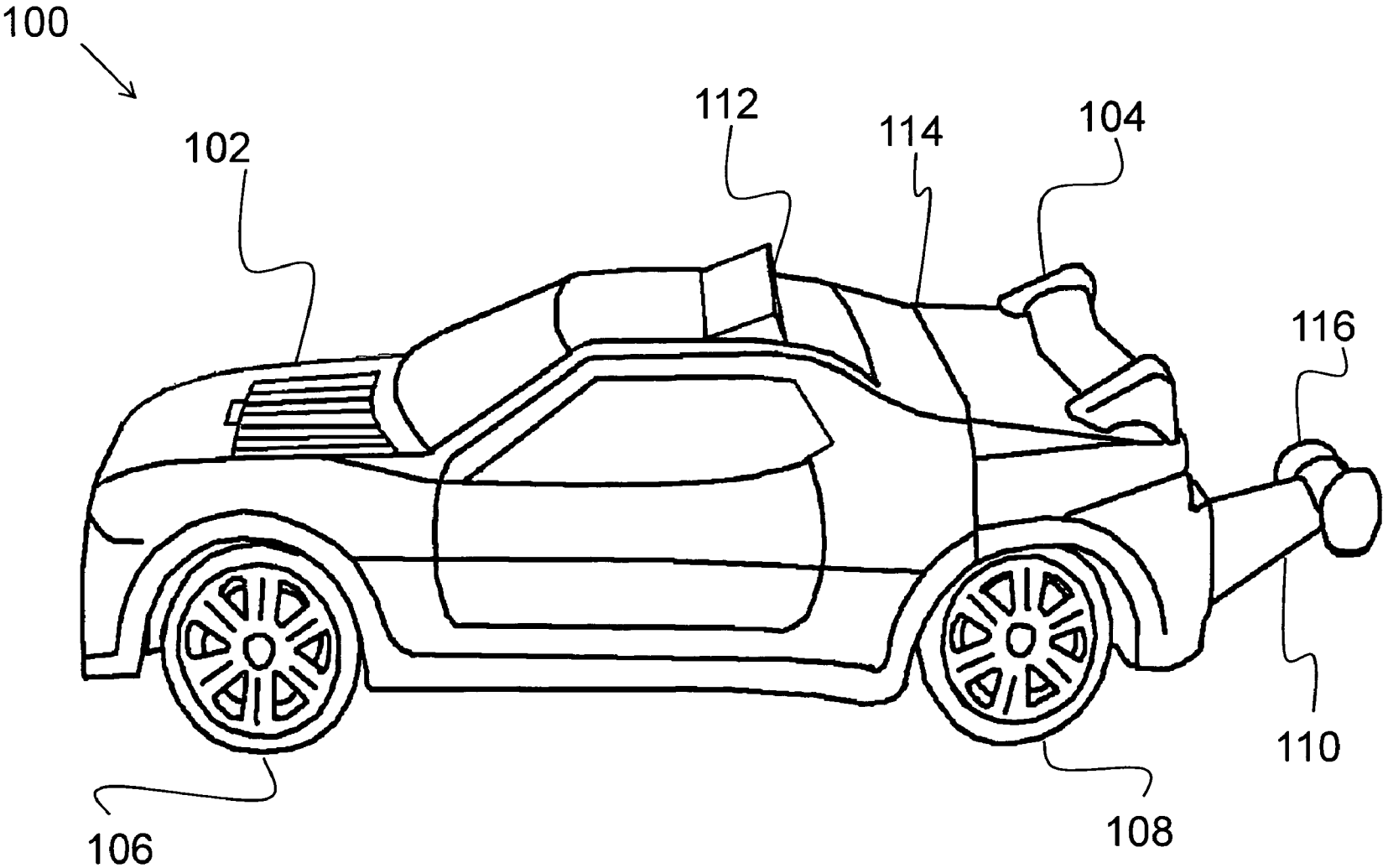
FIG. 1 is a side-view illustration of a spring-powered toy vehicle according to the present invention, depicting a front body portion, a rear body portion, a spring and a handle.

The spring-powered toy vehicle has a traditional shape and function. As illustrated in FIG. 1, the toy vehicle 100 has a front body portion 102 and a rear body portion 104, including at least a front wheel 106 and rear wheel 108, respectively. In one embodiment, the rear body portion 104 also includes a handle 110 which a user can grasp when preparing to launch the toy vehicle 100. Each of the front body portion 102 and rear body portion 104 are formed such that they are distinct and separate pieces with a distinct separation line 114 separating the two portions 102 and 104. The front and rear body portions 102 and 104 are allowed to touch and separate though the vehicle 100 is constructed in a manner that prevents separation that will distend the spring (depicted as element 202 in FIG. 2). The wheels 106 and 108 are rotationally connected with the toy vehicle 100 so that the toy vehicle 100 can be played with as an ordinary toy vehicle 100 independent of its spring-powered function.

In another aspect, the front body portion 102 is equipped with a thumb notch 112 on the roof area of the toy vehicle 100. The thumb notch 112 is placed on the windshield and hood of the toy vehicle 100 in another aspect. The thumb notch 112 allows a user to lightly place a thumb in it, steadying the toy vehicle. With the other hand, the user can then pull the handle 110 until the spring (depicted as element 202 in FIG. 2) is fully expanded. When the user finally releases the handle 110, the toy vehicle 100 leaps from under the user's thumb and thrusts forward. Also depicted is a handle peg 116. The handle peg 116 is attached with the handle 110 and can be used to assist a user in grasping the handle 110. Additionally, the handle peg 116 can be used with a launcher, as described in further detail below.

Figure 2:
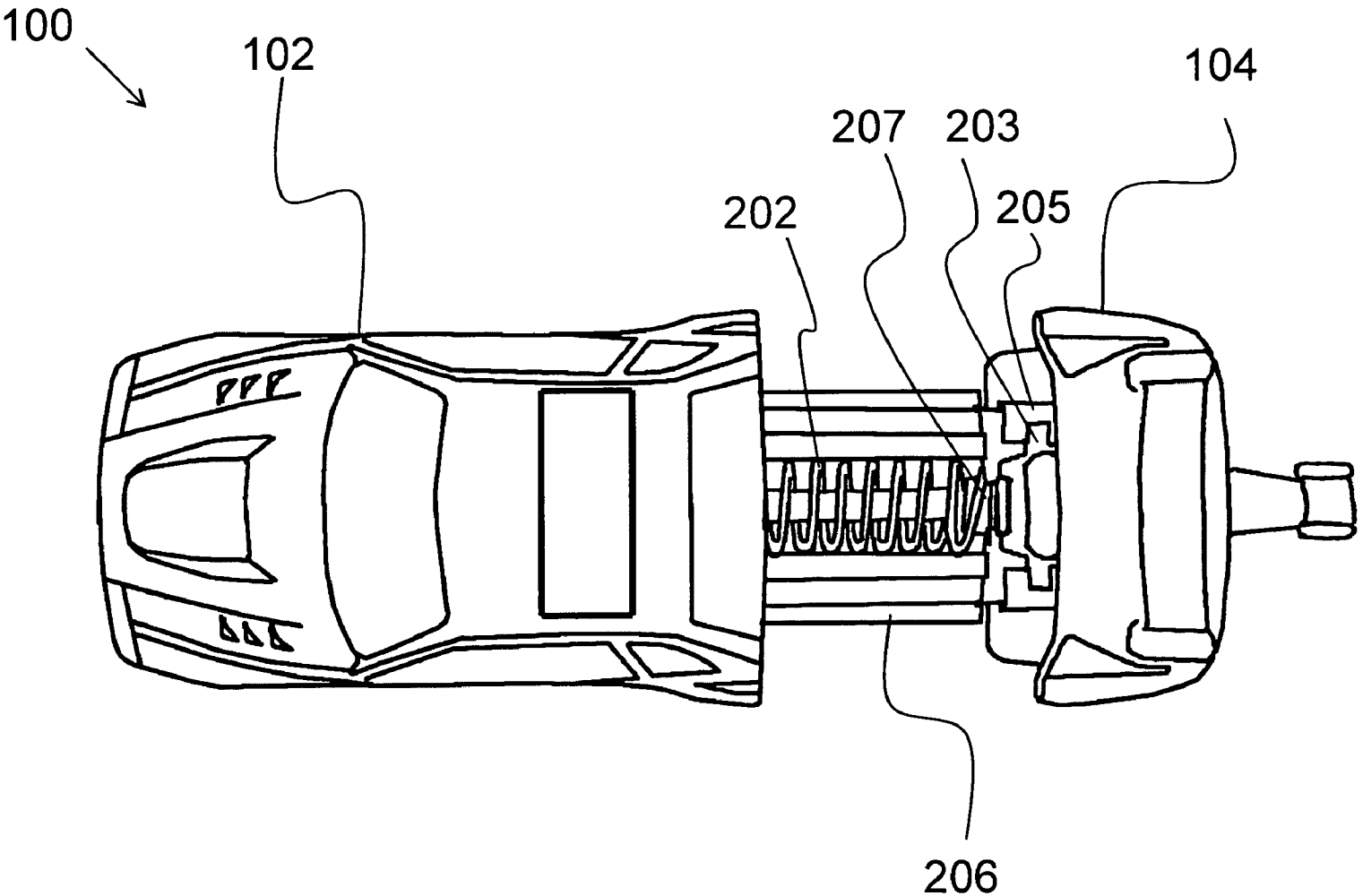
FIG. 2 is a top-view illustration of the spring-powered toy vehicle in an expanded state, depicting the rear body portion connected with a spring, a connecting rod, and a pair of parallel vehicle guides.

As shown in FIG. 2, the spring-powered toy vehicle 100 uses a manually-operated, spring-actuated propulsion mechanism to rapidly launch the toy vehicle 100 in one direction. FIG. 2 depicts the spring-powered toy vehicle 100 with a spring 202 that is connected with and between the rear body portion 104 and the front body portion 102. In this illustration, the rear body portion 104 has been pulled away from the front body portion 102, causing the spring 202 to expand and thus creating within it, potential energy. When the rear body portion 104 is then released, the spring 202 will pull the rear body portion 104 toward the front body portion 102 until the rear body portion 104 impacts the front body portion 102, converting the spring's 202 potential energy to kinetic energy and thus rapidly propelling the vehicle 100 forward.

As can be appreciated by one skilled in the art, the spring 202 is connected with and between the front and rear body portions 102 and 104 using any suitable connection mechanism or device. As a non-limiting example, the spring 202 has two opposing ends 207 and includes an attachment mechanism 203 at each of its ends 207 (note: only one end 207 is depicted in FIG. 2 as the other end is obscured by the front body portion 102). The attachment mechanism 203 is formed to attach with a corresponding spring receptacle 205 on each of the front and rear body portions 102 and 104. For example and as depicted in FIG. 2, the attachment mechanism 203 includes a projection that can be positioned within a corresponding slot within the posterior spring receptacle 205 of the rear body portion 104. Additionally, although not shown, one skilled in the art can appreciate that a similar attachment mechanism 203 and corresponding anterior spring receptacle 205 are included at the other end of the spring and within the front body portion 102. Thus, using the attachment mechanism 203 and corresponding spring receptacle 205, the spring 202 can be easily removed and replaced within the toy vehicle 100.

In another aspect, the front and rear body portions 102 and 104 are retractably connected with one another through any suitable mechanism or device. As a non-limiting example, the toy vehicle 100 includes a vehicle guide 206 which is connected with the rear body portion 104 and is inserted into a corresponding groove (depicted as element 306 in FIG. 3) on the front body portion 102.

Figure 3:
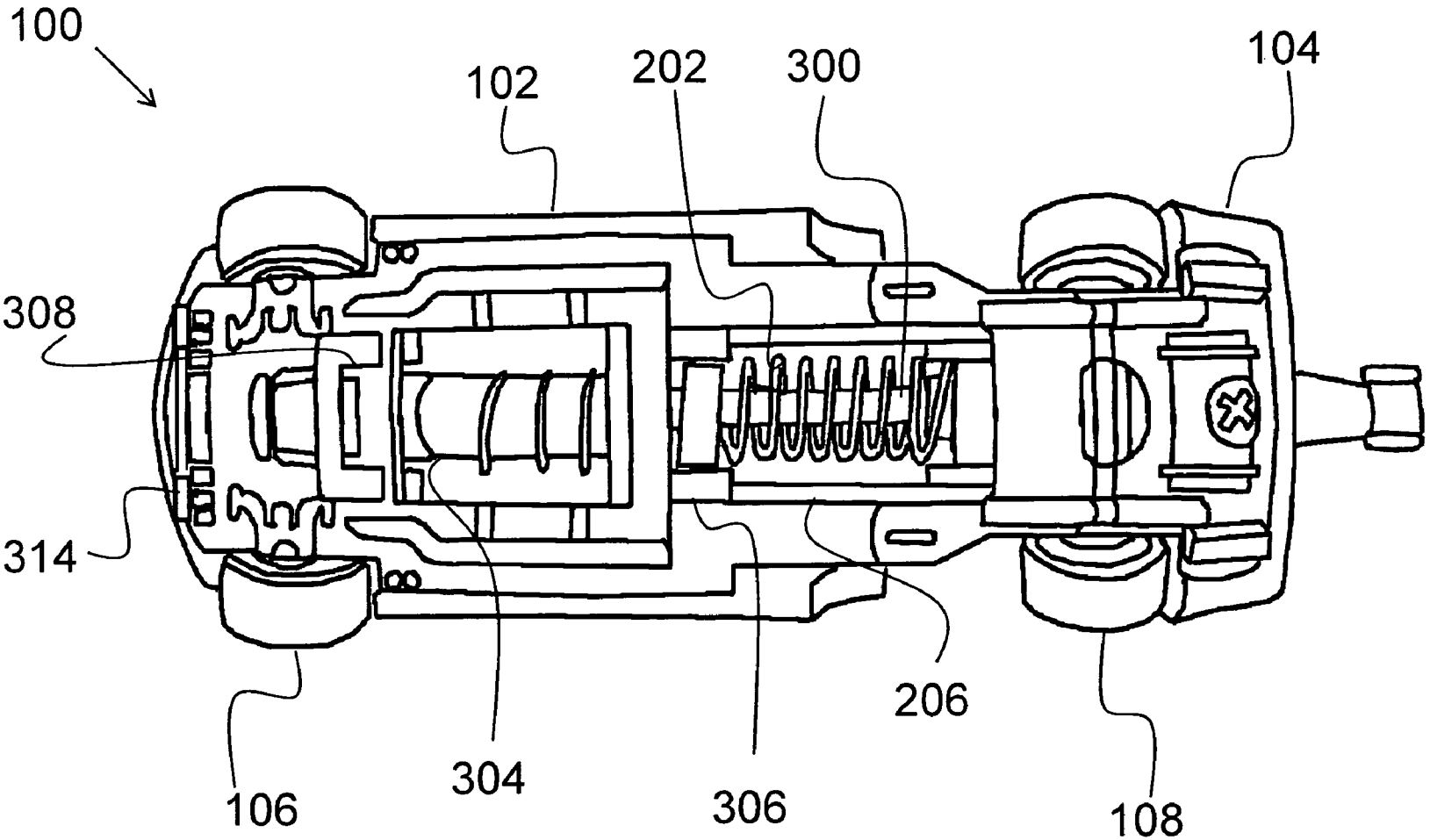
FIG. 3 is a bottom-view illustration of the spring-powered toy vehicle in the expanded state, depicting the spring and a cylinder for the connection rod which supports the spring.

In another aspect and as illustrated in FIG. 3, the spring 202 surrounds a connection rod 300 and a cylinder 304. Using the attachment mechanisms and spring receptacles, the connection rod 300 is connected with the rear body portion 104, while the cylinder 304 is connected with the front body portion 102. The cylinder 304 is hollow so as to enclose and protect the connection rod 300 when the spring 202 is contracted. The diameter of the hollow cylinder 304 is just large enough to accommodate the connection rod 300 though not so large as to allow the connection rod to move in a non-axial direction. Thus, when the rear body portion 104 has been pulled away from the front body portion 102, the spring 202 expands to build potential energy.

FIG. 3 depicts an underside of the toy vehicle 100 and as depicted in the figure, the connection rod 300 is only partially enclosed by the cylinder 304. The connection rod 300 and cylinder 304 move along an axis defined by the length of the connection rod 300, and the surrounding spring 202 is then compelled to move in only the same axial direction. The connection rod 300 and cylinder 304 therefore prevent the spring 202 and connected rear body portion 104 from expanding at an angle which would launch the toy vehicle 100 in a non-forward direction or reduce the forward momentum created by the spring 202. As briefly mentioned above, the toy vehicle 100 also includes a vehicle guide (depicted as element 206 in FIG. 2) which is connected with the rear body portion 104 and is inserted into a corresponding groove 306 on the front body portion 102.

In one embodiment of the present invention, the spring 202, having anterior and posterior ends, can be removed from the toy vehicle 100 and interchanged with another spring 202 with a different tension to either increase or decrease the power generated when the spring 202 is expanded and released. In such an embodiment, the spring 202, the connection rod 300, and the cylinder 304 are all removed as one spring assembly. To facilitate the removal of the spring assembly from the toy vehicle 100, the front body portion 102 and rear body portion 104 can be easily separated allowing access to the interior of the toy vehicle 100, as is further illustrated in FIG. 2. Insertion of the spring 202 assembly is achieved by securing the spring 202 within the front body portion 102 in an anterior spring receptacle and within the rear body portion 104, in a posterior spring receptacle 205. The spring 202 assembly can be removed either through the top or bottom of the toy vehicle 100, depending on the configuration of the toy. The ability to remove the front body portion 102 and rear body portion 104 also provides for multiple vehicle versions to be attached and reattached to the toy vehicle 100.

The vehicle guide 206 also serves to prevent the rear body portion 104 from being pulled back in a non-axial direction, and it also provides structural support to the toy vehicle 100 so the front body portion 102 and rear body portion 104 do not separate once the toy vehicle has been launched. In the aspect illustrated in FIG. 3, the vehicle guide 206 comprises two parallel tongue and groove 306 assemblies connecting the front body portion 102 with the rear body portion 104 while allowing the gap between them to expand to a limit and contract. However, one skilled in the art will appreciate that a singular vehicle guide 206 and groove 306 will accomplish a similar result. Collectively, the guide 206 and groove 306 operate as a guide 206 and groove 306 assembly.

Also depicted in FIG. 3 is a notch 308 at the bottom of the toy vehicle 100. As described in further detail below, the notch 308 is formed for use with a launcher device.

Figure 4:
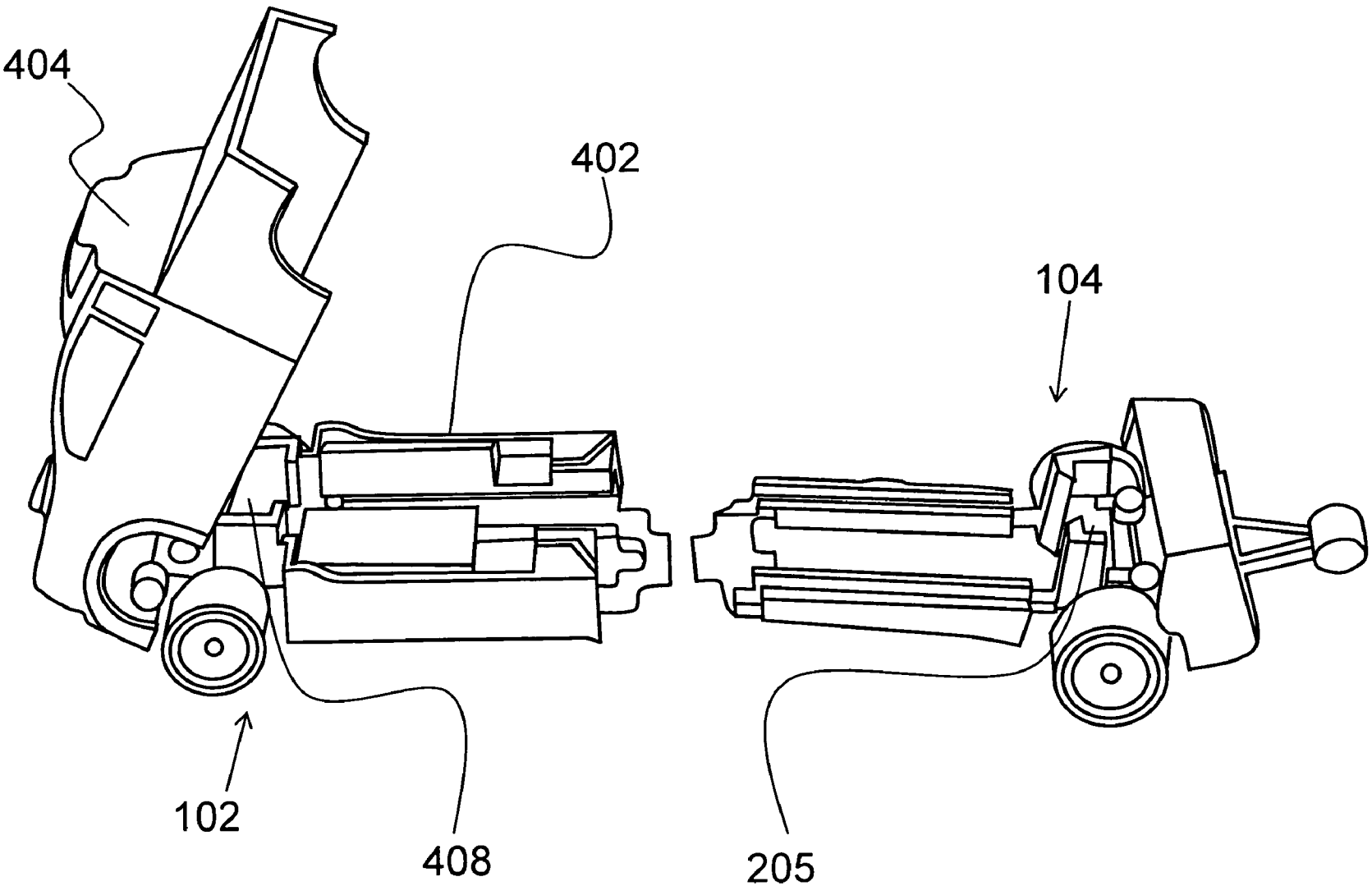
FIG. 4 is an illustration of the spring-powered toy vehicle with a shell portion opened to expose spring receptacles encased therein, also depicting the rear body portion disconnected from the front body portion, and exhibiting a rear body portion from a different like vehicle.

As illustrated in FIG. 4, front 102 and rear body 102 portions of like vehicles are interchangeable. As can be appreciated by one skilled in the art, the present invention also allows a user to replace the like vehicles or even different versions of a particular vehicle. For example, the vehicle depicted in FIG. 1 is a sport coupe while the vehicle depicted in FIG. 4 is a two-door auto with a covered pick-up truck cargo bay. In another aspect, the front body portion 102 includes, as illustrated in FIG. 4, both a front frame portion 402 and a front shell portion 404. The front shell portion 404 is hingedly (depicted as element 314 in FIG. 3) connected with the front frame portion 402 such that the front shell portion 404 operates as a flip-top that allows users to flip open the top of the front body portion 102 to have access to the spring assembly. FIG. 4 also demonstrates that the front 102 and rear 104 body portions are separable. The vehicle of FIG. 4 is depicted without the spring as it has been removed from the vehicle to further the previously hidden anterior spring receptacle 408. Also depicted is the posterior spring receptacle 205.

Figure 5:
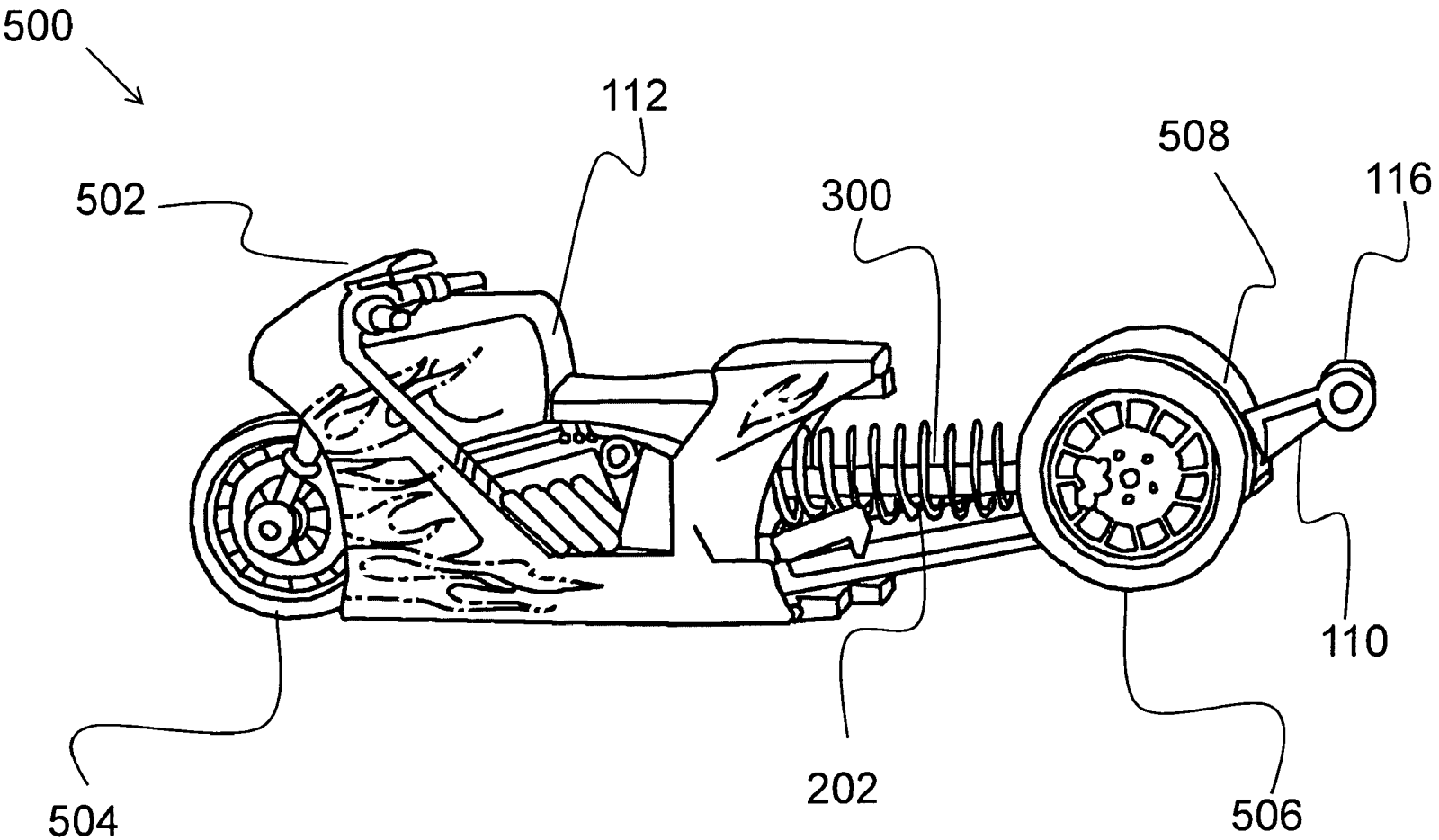
FIG. 5. is an illustration of a motorcycle version of the spring-powered toy vehicle in its expanded state.

This invention anticipates that there are a variety of vehicles that might be made into spring-powered toy vehicles. Without limitation, such vehicles include autos, motorcycles, trucks, planes and construction equipment. As a non-limiting example and as illustrated in FIG. 5, the present invention can also be formed as a spring-powered motorcycle 500. FIG. 5 illustrates a spring-powered motorcycle 500 in its expanded state. The motorcycle 500 has a single front wheel 504 and a rear wheel 506. The rear wheel 506 is attached with a rear body portion 508 and can be a single wheel or made to appear as a single wheel. When made to appear as a single wheel, the rear wheel 506 is in actuality two thin wheels with a spacer (e.g., plastic spacer) between them. The rear wheel 506 is a rear wheel assembly in this version and is configured to look like a single wheel but instead includes two wheels to provide additional balance to the motorcycle 500. This aspect has a front body portion 502 with a front segment to which the front wheel 504 and the anterior end of the spring 202 are attached.

As was the case with the previous aspect, the motorcycle 500 can also be formed to include a thumb notch 112, a handle 110, and a handle peg 116. The thumb notch 112 is used to steady the motorcycle 500 while the handle 110 is used to pull the rear body portion 508 from the front body portion 502. Finally, the handle peg 116 can be used as a grasping aid or with the launcher as described below.

Figure 6:
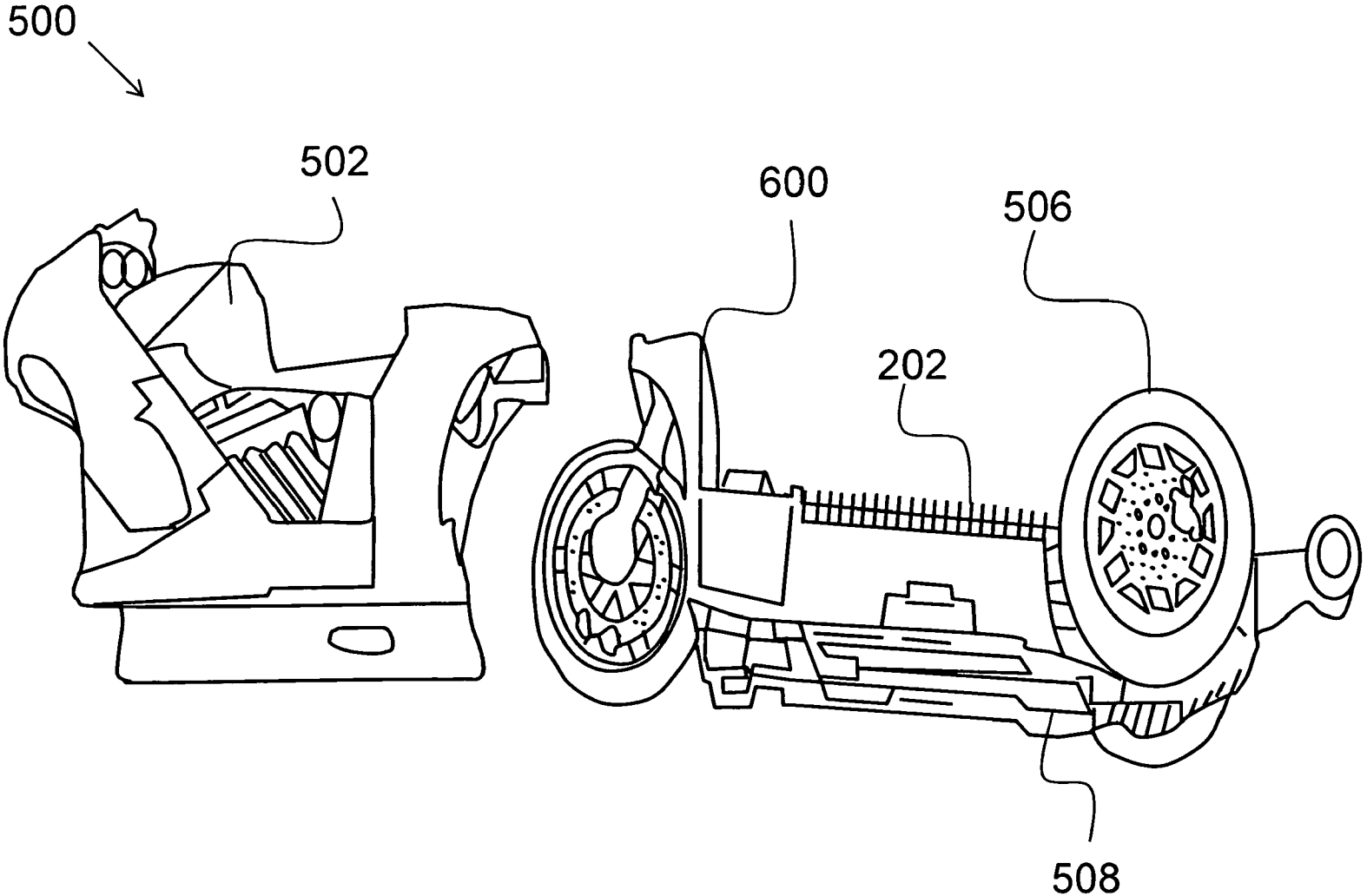
FIG. 6 is an illustration of a motorcycle version of the vehicle with a removable front body portion that has been removed and also showing the front segment and the rear body portion.

As shown in FIG. 6, the motorcycle 500 also includes a rear body portion 508 to which the rear wheels 506 and the posterior of the spring 202 are attached. The front body portion 502 removably attaches on top of the front segment 600 of the rear body portion 508. Thus, the front body portion 502 is removable as depicted in this illustration. When the front body portion 502 is installed, it completely covers the front segment 600 and allows easy access to the spring 202.

Figure 7:
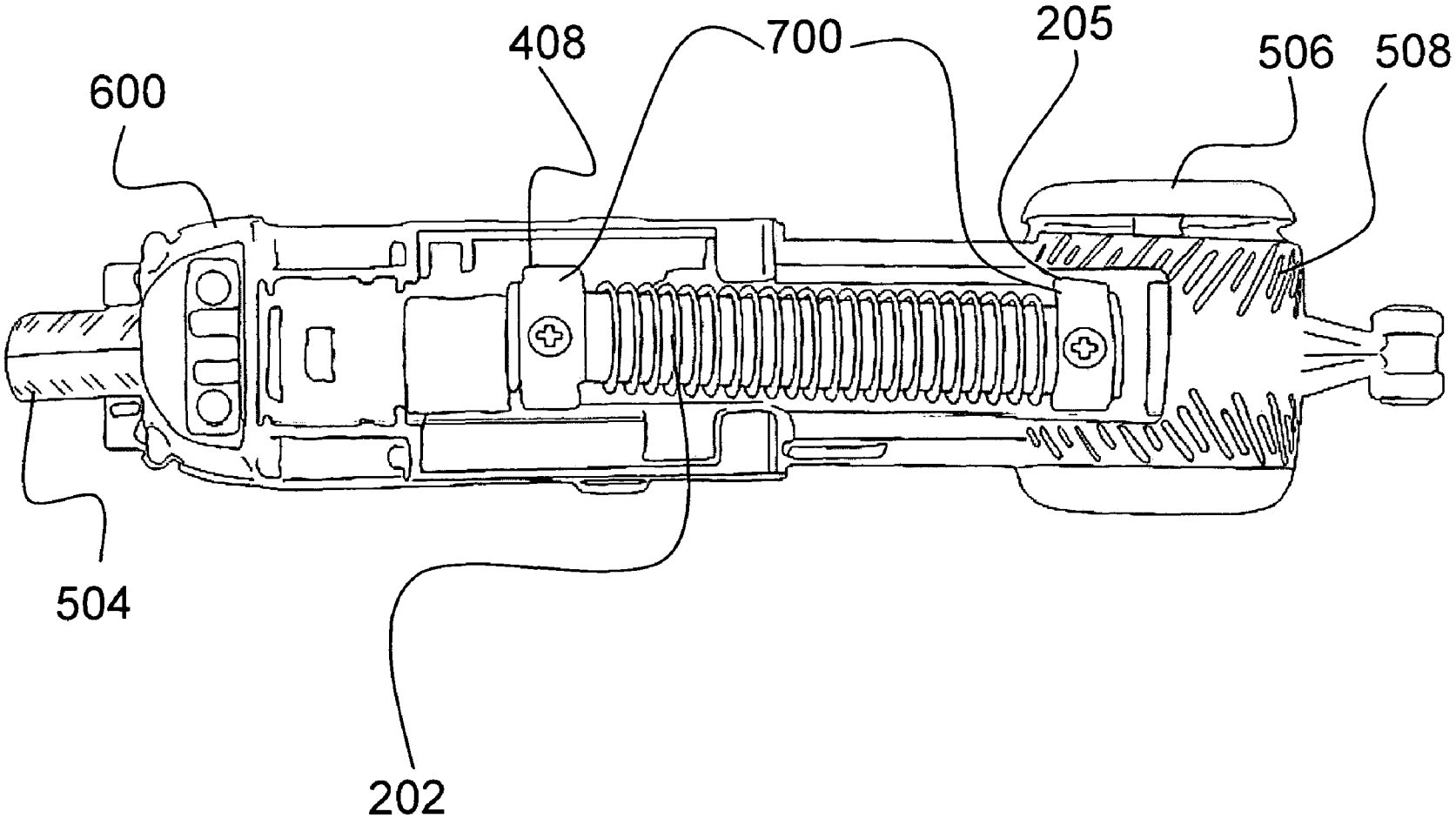
FIG. 7 is an illustration of a motorcycle rear body portion and front segment, expanded to show the expanded spring assembly in detail.

FIG. 7 is an illustration that depicts the motorcycle from a different aspect. The front body portion has been removed (and is not displayed in the drawing) and the front body segment 600 and rear body portion 508 have been separated to expose the expanded spring assembly 202 in detail. This drawing demonstrates the rear wheels 506 (as described above) and a single front wheel 504 to accentuate the motorcycle theme of this vehicle. Also detailed are the anterior spring receptacle 408, the posterior spring receptacle 205 and raised cylindrical bands 700.

Figure 8:
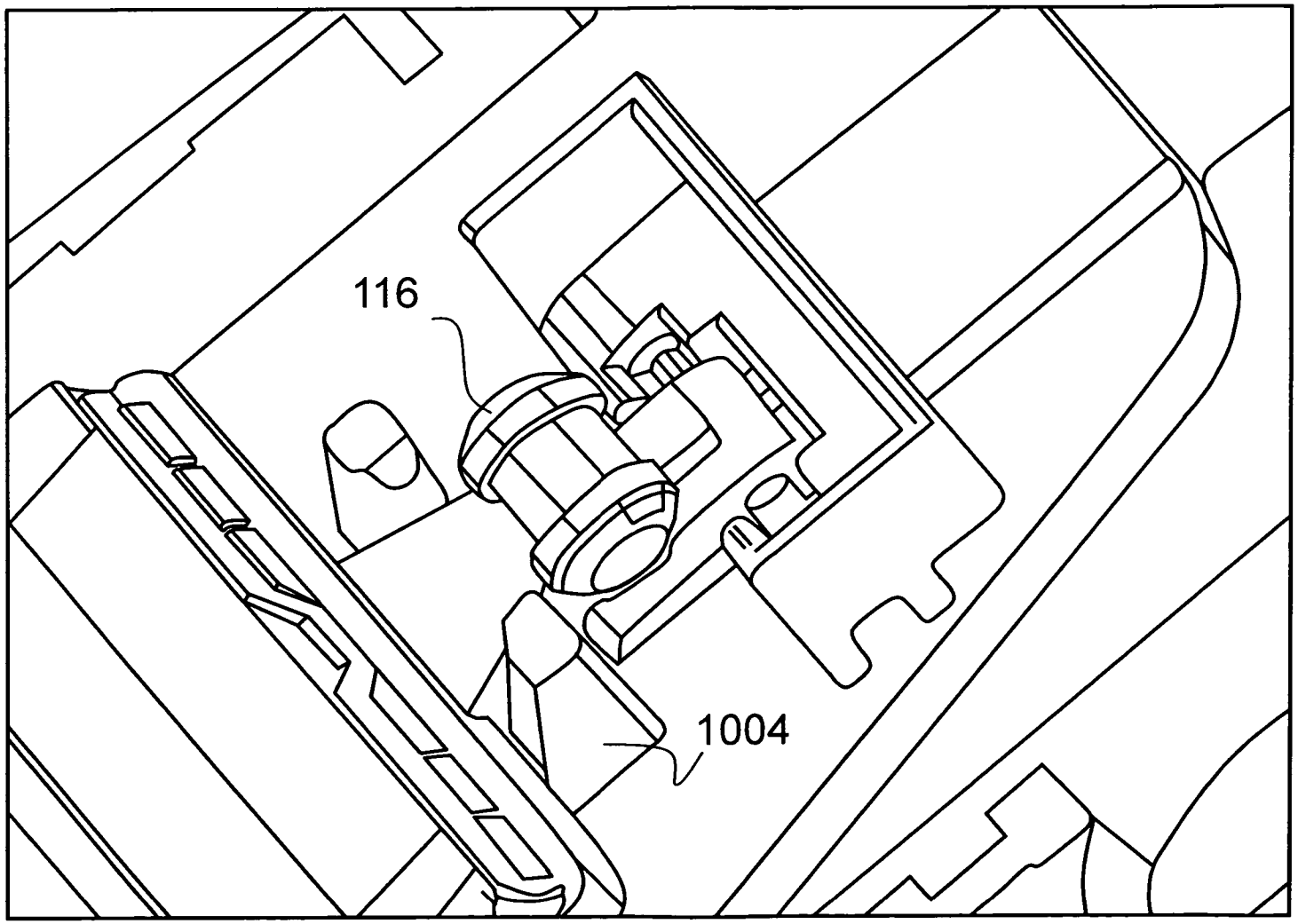
FIG. 8 is an illustration of a handle peg of the spring-powered toy vehicle secured with a u-shaped retaining receptacle at an anterior end of a plunger.
Figure 9:
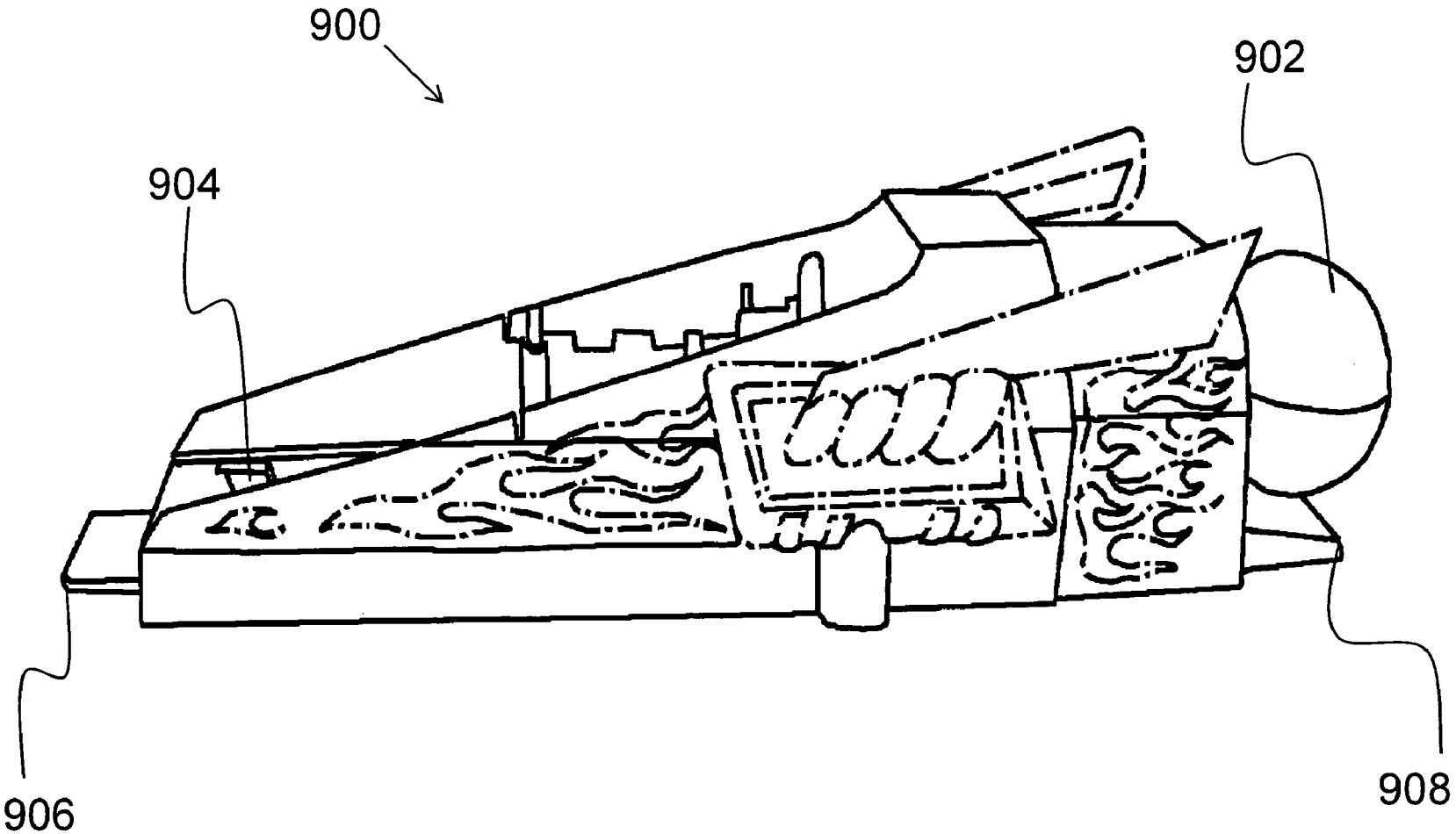
FIG. 9 is a perspective, side-view illustration of a launcher according to the present invention.

As described above and as illustrated in FIGS. 8 through 12, the present invention also includes a launcher. Illustrated in FIG. 8 is a detailed perspective view of the inside of a launcher according to the present invention. Although a more general view of the launcher is depicted in FIGS. 9 through 1, FIG. 8 is provided to illustrate an example of a mechanism by which the launcher connects with the toy vehicle to launch the toy vehicle. More specifically, FIG. 8 illustrates details of the handle peg 116 (as depicted in FIG. 1) secured into the retaining receptacle 1004 (as shown in FIG. 10).

As shown in FIG. 9, the spring-powered toy vehicle utilizes the launcher 900 to provide a stable platform and an additional source of power for launching the toy vehicle. A perspective-view illustration of a launcher 900 is shown in FIG. 9. The launcher 900 has a plunger (depicted as element 1006 in FIG. 10A and having an anterior and posterior end) that is slideably connected with the launcher 900. A plunger handle 902 is connected with the plunger to allow a user to grasp the plunger handle 902 and pull back the plunger. Additionally, the launcher includes two distinct ends, a launching end 906 and a plunger handle end 908. Further, the launcher 900 includes a spring-loaded peg 904 for engaging with the notch (depicted as element 308 in FIG. 3) of the toy vehicle. In operation, the toy vehicle is placed into the launcher 900 with its anterior end facing toward the launching end 906.

Figure 10A:
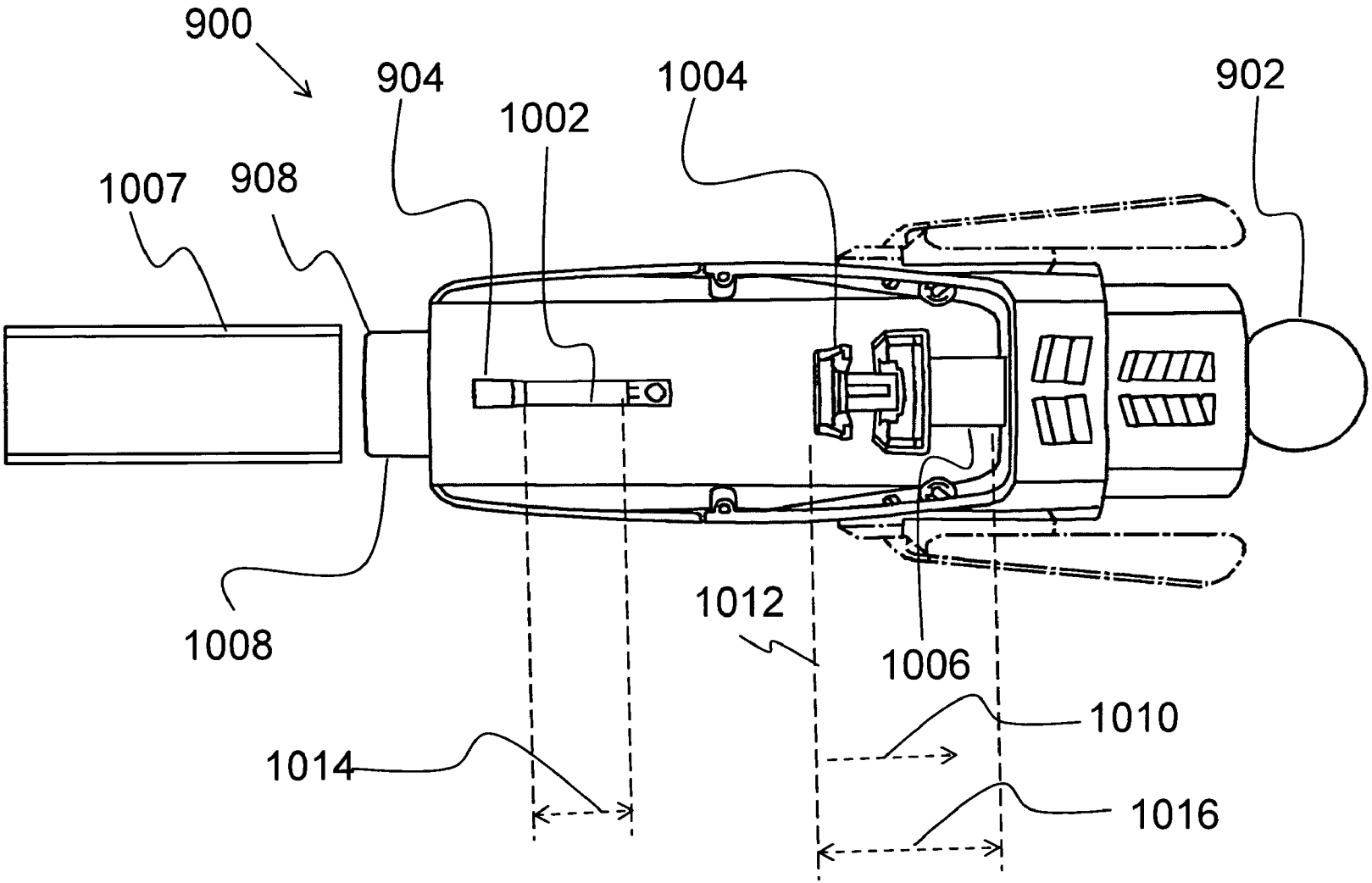
FIG. 10A is a top-view illustration of the launcher.

FIG. 10A shows a top-view illustration of the launcher 900. The spring-loaded peg 904 resides within a slot 1002 assembly and is formed to engage a notch at the bottom of the toy vehicle 100. The handle peg (depicted as element 116 in FIG. 1) of the toy vehicle is secured in a hinged, u-shaped, pivoting retaining receptacle 1004 on the anterior end of the plunger 1006

Both the plunger 1006 and the spring-loaded peg 904 and slot 1002 assembly are spring-loaded and are allowed limited travel. The plunger 1006 is spring-loaded such that once it is pulled back 1010 from a starting position 1012 and released, the plunger 1006 returns to the starting position 1012. The plunger 1006 has a range of travel 1016 that is necessarily greater than the range of travel 1014 of the spring-loaded peg 904. When the plunger 1006 is pulled back using the plunger handle 902, the rear body portion (depicted as element 104 in FIG. 1) of the toy vehicle pulls the front body portion (depicted as element 102 in FIG. 1), which is dragged by the spring-loaded peg 904. When the spring-loaded peg 904 reaches its limit of travel (i.e., range of travel 1014), the plunger 1006 still extends the toy vehicle until the spring 202 reaches its limit.

Figure 10B:
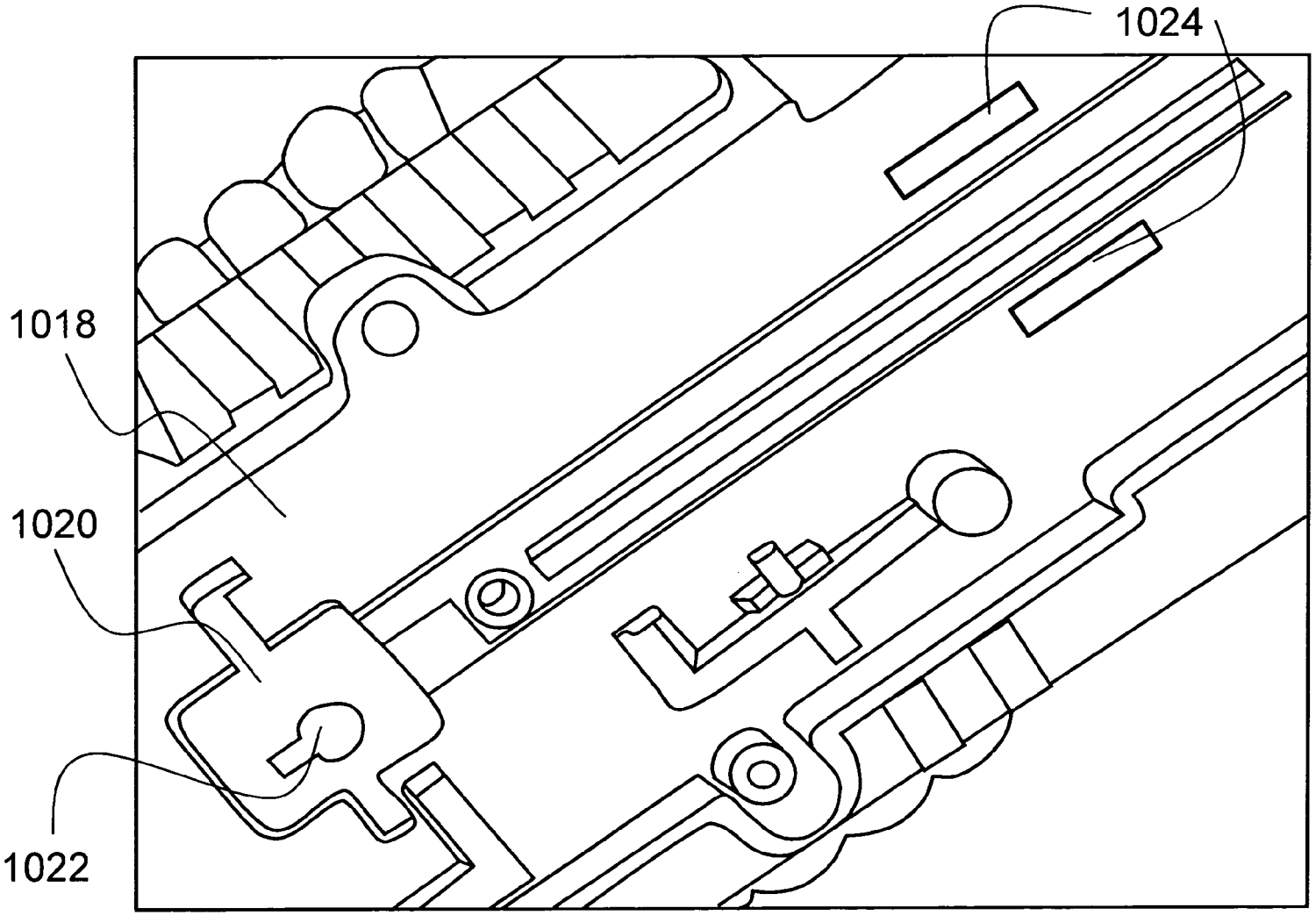
FIG. 10B is an illustration of an underside of a ramp of the launcher as viewed from an interior end of the launcher.

FIG. 10B details the underside of the ramp 1018 and the portion of the retaining receptacle (shown in FIG. 10A as element 1004) that cannot be seen by an observer. The retaining receptacle has a rod at its base that extends to the underside of the ramp where it is attached with a rectangular plate 1020 (the connection point 1022 of the rod is visible on the rectangular plate 1020). When the plunger 1006 reaches the point where the spring (depicted as element 202 in FIG. 2) is extended to its limit, the rectangular plate 1020 passes over a pair of humps 1024 that cause the rectangular plate 1020 to tilt up, which in turn, causes the retaining receptacle to pivot down, which releases the vehicle and permits it to explode out of the launcher 900.

Referring again to FIG. 10A, once the handle peg is released, the rear body portion accelerates rapidly toward the front body portion. The spring-loaded plunger 1006, the spring-loaded peg 904 and slot 1002 assembly and the spring 202 of the toy vehicle all contribute their potential energy to the kinetic energy released in the toy vehicle. As mentioned above, it should also be noted that the plunger 1006 includes a range of travel 1016 such that the range of travel 1014 within the slot 1002 (for the peg 904) is less than the range of travel 1016 of the plunger 1006.

A further aspect utilizes the launcher 900 in conjunction with a track 1007. A tab 1008 on the launching end 906 of the launcher 900 can be inserted into a slot on the track 1007. Once a toy vehicle is launched, it races on the track 1007 until its kinetic energy is spent.

Figure 11:
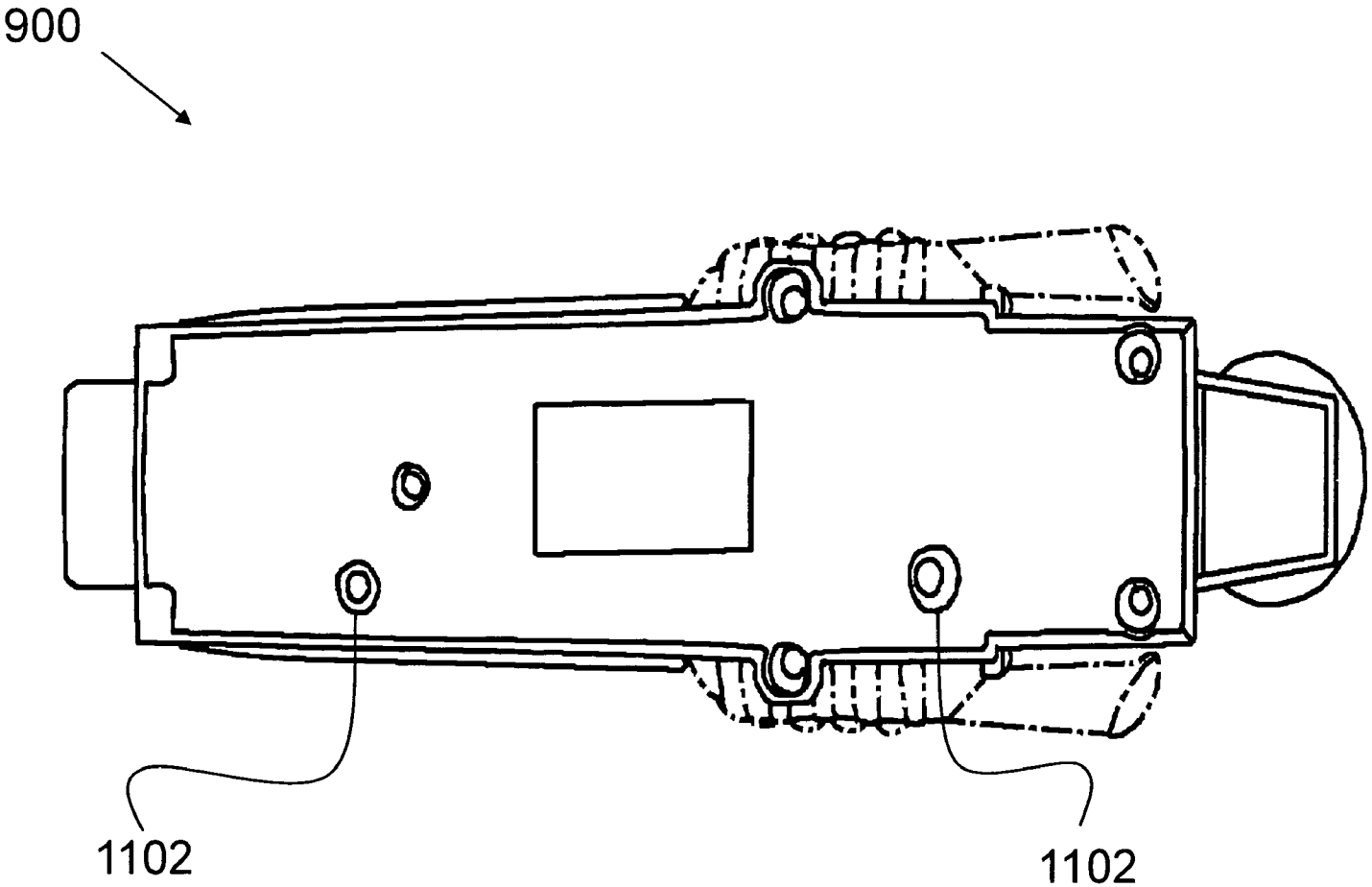
FIG. 11 is a bottom-view illustration of the launcher.

FIG. 11 shows a bottom-view illustration of the launcher. As an optional aspect, the bottom of the launcher 900 can be formed to include at least one sensor 1102 that senses when the launcher 900 is on a flat surface. Thus, when the vehicle 100 is placed in the launcher 900, a pull of the spring-loaded plunger 1006 extends the spring of the spring-loaded plunger 1006 if the sensor 1102 indicates that the launcher 900 is on a flat surface. In other words, various portions of the launcher 900 can be locked up if the sensor 1102 indicates that the launcher 900 is not on a flat surface. For example, the spring-loaded plunger 1006 can be locked up, or alternatively, the spring-loaded peg 904 can be held in place by another locking mechanism. In a desired aspect, the locking mechanism prevents the plunger 1006 from moving unless the launcher 900 is on a flat surface.

Figure 12:
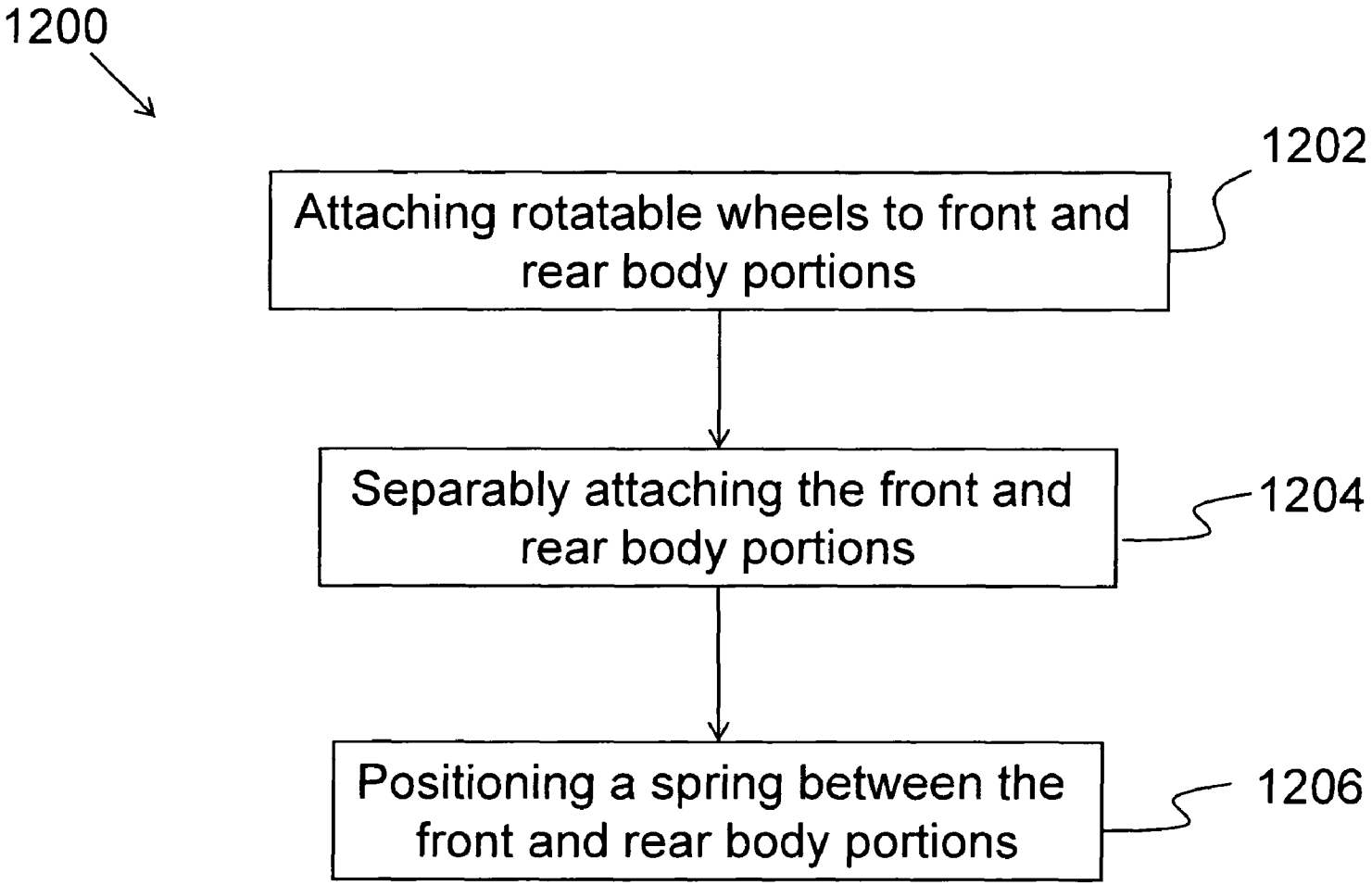
FIG. 12 is a flowchart illustrating a method for forming a spring-powered toy vehicle according to the present invention.

As shown in FIG. 12, the present invention also teaches a method 1200 for forming a spring-powered toy vehicle. The method 1200 comprises a plurality of acts of forming and attaching each of the parts of the toy vehicle and launcher described herein. For example, the method 1200 comprises acts of attaching 802 at least one rotatable wheel to a front body portion and at least one rotatable wheel to a rear body portion. The method 1200 also includes an act of removably attaching 1204 the front and rear body portions such that the body portions touch but also achieve a limited separation point. Finally, the method 1200 also includes an act of positioning 1206 a spring between each of the front and rear body portions. As can be appreciated by one skilled in the art, the present invention further comprises additional acts of forming and attaching the various parts of the toy vehicle and launcher described above to arrive at the present invention.

What is claimed is:

1. A spring-powered toy, comprising:

a spring-powered toy vehicle, the spring-powered toy vehicle including:

a front body portion having at least one wheel rotatably attached thereto;

a rear body portion having at least one wheel rotatably attached thereto; and a spring attached with and between the front body portion and the rear body portion such that the front body portion is separably connected with the rear body portion, whereby the spring provides a contracting force when the rear body portion is pulled away from the front body portion and the spring is extended, the contracting force being suitable for propelling the toy in a direction of travel once the rear body portion is released to cause the rear body portion to contact the front body portion;

further comprising a guide and groove assembly connected with and between the front body portion and the rear body portion, the guide and groove assembly being operable to allow the front body portion to separate from the rear body portion in an axial direction;

wherein the spring has two opposing ends and further includes two attachment mechanisms, each attachment mechanism connected at one of the ends, and further comprising two spring receptacles, wherein one spring receptacle is formed in the front body portion and another spring receptacle is formed in the rear body portion, wherein each attachment mechanism is formed to connect with a corresponding spring receptacle such that the spring can be detachably attached between the front body portion and the rear body portion by detachably attaching each attachment mechanism with its corresponding spring receptacle;

further comprising a thumb notch formed on the front body portion for allowing a user to stabilize the toy vehicle while pulling the rear body portion from the front body portion;

further comprising a handle attached with the rear body portion for allowing a user to grasp the handle and pull the rear body portion from the front body portion, whereby when a user places a thumb in the thumb notch and with another hand grasps the handle and extents the rear body portion of the spring-powered toy vehicle away from the front body portion and thereafter lets go of the handle, the spring-powered toy vehicle is propelled forward in a direction of travel; and wherein the front body portion includes both a front frame portion and a front shell portion, wherein the front shell portion is hingedly connected with the front frame portion such that the front shell portion operates as a flip-top that allows users to flip open the front body portion to have access to the spring;

wherein the toy vehicle is formed in a shape to represent a vehicle selected from a group consisting of an auto, a truck, a motorcycle, a construction vehicle, and a plane;

further comprising a cylinder positioned around the spring to provide protection for the spring and structural support for the spring-powered toy vehicle;

further comprising a launcher that is formed to connect with the toy vehicle and launch the toy vehicle; and wherein the toy vehicle includes an underside with a notch and further includes a handle peg attached with the rear body portion, and wherein the launcher further comprises:

a spring-loaded plunger having a range of travel, the plunger being spring-loaded so that once the plunger is pulled back from a starting position and released, the plunger returns to the starting position;

a spring-loaded peg and slot assembly attached with the launcher, where the spring-loaded peg is formed to fit into the notch on the underside of the toy vehicle and wherein the spring-loaded peg is positioned within the slot such that the slot allows the spring-loaded peg to have a range of travel within the slot that is less than the range of travel of the plunger;

a retaining receptacle formed at an anterior end of the plunger, the receptacle being formed to retain the handle peg therein, whereby in operation, when the plunger is pulled, the handle peg is retained in the receptacle, while the spring-loaded peg is caught on the notch, and when the plunger is pulled far enough such that the spring-loaded peg reaches the limit of its travel, the retaining receptacle releases the handle peg, causing the rear body portion to be forced forward and thereby imparting propulsive force to the spring-powered toy vehicle propelling it in the direction of travel.

2. The spring-powered toy as set forth in claim 1, wherein the launcher further comprises:

a housing with a ramp and an underside;

wherein the ramp includes a pair of humps on the underside of the ramp;

wherein the retaining receptacle is a spring-loaded, hinged, and pivoting retaining receptacle, mounted on a rod that extends to the underside of the ramp and connects to a rectangular plate, the receptacle being formed at an anterior end of the plunger and also being formed to retain the handle peg therein, whereby in operation, when the plunger is pulled, the handle peg is retained in the receptacle, while the spring-loaded peg is caught on the notch, and when the plunger is pulled far enough such that the spring-loaded peg reaches a limit of its travel, the rectangular plate rides up the pair of humps on the underside of the ramp causing the rectangular plate to tilt up which causes the retaining receptacle to pivot down, releasing the handle peg from the retaining receptacle, causing the rear body portion to be forced forward and thereby imparting propulsive force to the spring-powered toy vehicle and propelling it in a direction of travel.

3. The spring-powered toy as set forth in claim 2, wherein the launcher further comprises a tab that is formed to fit into a track assembly, thereby allowing the launcher to be removably attached to the track assembly.

4. The spring-powered toy as set forth in claim 3, further comprising at least one sensor attached with the launcher, the sensor being operable to sense when the launcher is on a flat surface and further comprising a locking mechanism that disables the plunger when the launcher is not positioned upon a flat surface.

5. A spring-powered toy, comprising:

a spring-powered toy vehicle, the spring-powered toy vehicle including:

a front body portion having at least one wheel rotatably attached thereto;

a rear body portion having at least one wheel rotatably attached thereto; and a spring attached with and between the front body portion and the rear body portion such that the front body portion is separably connected with the rear body portion, whereby the spring provides a contracting force when the rear body portion is pulled away from the front body portion and the spring is extended, the contracting force being suitable for propelling the toy in a direction of travel once the rear body portion is released to cause the rear body portion to contact the front body portion;

further comprising a launcher that is formed to connect with the toy vehicle and launch the toy vehicle; and wherein the toy vehicle includes an underside with a notch and further includes a handle peg attached with the rear body portion, and wherein the launcher further comprises:

a spring-loaded plunger having a range of travel, the plunger being spring-loaded so that once the plunger is pulled back from a starting position and released, the plunger returns to the starting position;

a spring-loaded peg and slot assembly attached with the launcher, where the spring-loaded peg is formed to fit into the notch on the underside of the toy vehicle and wherein the spring-loaded peg is positioned within the slot such that the slot allows the spring-loaded peg to have a range of travel within the slot that is less than the range of travel of the plunger;

a retaining receptacle formed at an anterior end of the plunger, the receptacle being formed to retain the handle peg therein, whereby in operation, when the plunger is pulled, the handle peg is retained in the receptacle, while the spring-loaded peg is caught on the notch, and when the plunger is pulled far enough such that the spring-loaded peg reaches the limit of its travel, the retaining receptacle releases the handle peg, causing the rear body portion to be forced forward and thereby imparting propulsive force to the spring-powered toy vehicle propelling it in the direction of travel.

6. The spring-powered toy as set forth in claim 5, wherein the launcher further comprises:

a housing with a ramp and an underside;

wherein the ramp includes a pair of humps on the underside of the ramp;

wherein the retaining receptacle is a spring-loaded, hinged, and pivoting retaining receptacle, mounted on a rod that extends to the underside of the ramp and connects to a rectangular plate, the receptacle being formed at an anterior end of the plunger and also being formed to retain the handle peg therein, whereby in operation, when the plunger is pulled, the handle peg is retained in the receptacle, while the spring-loaded peg is caught on the notch, and when the plunger is pulled far enough such that the spring-loaded peg reaches a limit of its travel, the rectangular plate rides up the pair of humps on the underside of the ramp causing the rectangular plate to tilt up which causes the retaining receptacle to pivot down, releasing the handle peg from the retaining receptacle, causing the rear body portion to be forced forward and thereby imparting propulsive force to the spring-powered toy vehicle and propelling it in a direction of travel.

* * * * *